US007169238B2

(12) United States Patent
Walenta et al.

(10) Patent No.: US 7,169,238 B2
(45) Date of Patent: Jan. 30, 2007

(54) CARBIDE METHOD AND ARTICLE FOR HARD FINISHING RESULTING IN IMPROVED WEAR RESISTANCE

(75) Inventors: John B. Walenta, Peoria, IL (US); Charles F. Berndt, Pekin, IL (US); Thomas E. Clements, Peoria, IL (US); Steven M. Cross, Peoria, IL (US); Timothy M. Hoefft, Morton, IL (US); Gary D. Keil, Hanna City, IL (US)

(73) Assignee: Caterpillar Inc, Peoria, IL (US)

( * ) Notice: Subject to any disclaimer, the term of this patent is extended or adjusted under 35 U.S.C. 154(b) by 298 days.

(21) Appl. No.: 10/745,107

(22) Filed: Dec. 22, 2003

(65) Prior Publication Data

US 2005/0133120 A1 Jun. 23, 2005

(51) Int. Cl.
*C23C 8/22* (2006.01)

(52) U.S. Cl. ..... 148/233

(58) Field of Classification Search ..... 148/233
See application file for complete search history.

(56) References Cited

U.S. PATENT DOCUMENTS

| | | | | |
|---|---|---|---|---|
| 3,398,444 | A | 8/1968 | Nemy | |
| 3,895,972 | A | 7/1975 | Woodilla, Jr. et al. | |
| 4,202,710 | A * | 5/1980 | Naito et al. | 148/233 |
| 4,373,973 | A | 2/1983 | Cellitti et al. | |
| 4,761,867 | A | 8/1988 | Vollmer et al. | |
| 4,921,025 | A | 5/1990 | Tipton et al. | |
| 5,181,375 | A | 1/1993 | Thurman et al. | |
| 5,536,335 | A | 7/1996 | Burris et al. | |
| 5,595,613 | A | 1/1997 | Hatano et al. | |
| 5,656,106 | A | 8/1997 | Amateau et al. | |
| 5,910,223 | A | 6/1999 | Tipton et al. | |
| 6,019,857 | A | 2/2000 | Mutagami | |
| 6,059,898 | A | 5/2000 | Fisher et al. | |
| 6,258,179 | B1 | 7/2001 | Takayama et al. | |

(Continued)

FOREIGN PATENT DOCUMENTS

| | | |
|---|---|---|
| EP | 0033403 | 8/1981 |

(Continued)

OTHER PUBLICATIONS

Davis et al., ASM Handbook, 1995, ASM International, vol. 4, p. 376.*

(Continued)

*Primary Examiner*—Roy King
*Assistant Examiner*—Michael P. Alexander
(74) *Attorney, Agent, or Firm*—Kevin C. Earle

(57) ABSTRACT

An article and method for forming an article having a hard-finished surface including a predetermined density of carbides to improve pitting and wear resistance and to significantly increase the overall life of the article. This method comprises selecting a carburizing grade material to form an article, carburizing the article to form a microstructure on at least one portion of the article having a predetermined density of carbides dispersed in the microstructure to a predetermined depth, quenching the article to form a hardened matrix dispersed with carbides and hard finishing the article to form the surface, the surface having at least approximately 20% by volume fraction carbides dispersed in the hardened matrix.

33 Claims, 5 Drawing Sheets

U.S. PATENT DOCUMENTS

| | | | |
|---|---|---|---|
| 6,488,788 | B2 | 12/2002 | Ito et al. |
| 6,537,390 | B1 | 3/2003 | Goto |
| 6,589,363 | B2 | 7/2003 | Rohde et al. |
| 2002/0179205 | A1 | 12/2002 | Ohbayashi et al. |

FOREIGN PATENT DOCUMENTS

| | | | |
|---|---|---|---|
| EP | 0950723 | | 10/1999 |
| EP | 1070760 | | 1/2001 |
| EP | 1099869 | | 5/2001 |
| JP | 57-177864 | * | 11/1982 |
| JP | 04-032548 | * | 2/1992 |
| JP | 11-300528 | * | 11/1999 |
| WO | WO 89/05865 | | 6/1989 |
| WO | WO 00/77265 | | 12/2000 |

OTHER PUBLICATIONS

Patent Abst of JP vol. 1995 #03, Apr. 28, 1995 & JP 06340921; Kawasaki Heavy Ind Ltd.

Patent Abst of JP vol. 8 #122 (C-227), Jun. 8, 1984 & JP 59035630 Komatsu, Feb. 27, 1984.

Patent Abst of JP vol. 13 #504 (C-653), Nov. 12, 1989 & JP 01201459 Daido Steel Co Ltd.

Patent Abst of JP vol. 14 #314 (C-0737) Jul. 5, 1990 & JP 02107755 Koyo Seiko Co Ltd Apr. 19, 1990.

Patent Abst of JP vol. 15 #68 (C-0807) Feb. 18, 1991 & JP 02294462 Mazda Motor Corp Dec. 5, 1990.

Patent Abst of JP vol. 1996 #09 Sep. 30, 1996 & JP 08134623 Kobe Steel; Nippon Koshuha Kogyo KK May 28, 1996.

Patent Abst of JP vol. 010 #287 (C-375) Sep. 30, 1986 & JP 61104065 Daido Steel Co Ltd May 22, 1986.

Patent Abst of JP vol. 1999 #12 Oct. 29, 1999 & JP 11199983 Nissan Motor Co Ltd; Daido Steel Co Ltd Jul. 27, 1999.

Patent Abst of JP vol. 16 #310 (C-0960) Jul. 8, 1992 & JP 04088148 Kobe Steel Ltd Mar. 23, 1992.

Patent Abst of JP May 30, 1990 & JP 04032548 Nissan Motor Co Feb. 4, 2002.

Patent Abst of JP vol. 16 #244 (C-0947) Jun. 4, 1992 & JP 04052265 Daido Steel Co Ltd Feb. 20, 1992.

"Application of Super Carburizing to Hydraulic Lash Adjuster", Namiki et al., Copyright 1988 Society of Automotive Engineers, Inc.

"Development of Supercarburized Tappet Shim to Improve Fuel Economy", Ahn et al., Copyright 2000 Society of Automotive Engineers, Inc.

"Heat Treatments to Improve the Rolling-Contact Fatigue Life for Crank Pin of Motorcycles", Yamagata et al., Copyright 2003 SAE International.

* cited by examiner

CARBIDE METHOD AND ARTICLE FOR HARD FINISHING RESULTING IN IMPROVED WEAR RESISTANCE

TECHNICAL FIELD

The present invention relates generally to a method for heat treatment and more particularly to a method for carbide carburizing and hardening an article to a predetermined depth followed by hard finishing, and a resulting article.

BACKGROUND

Carburizing is an effective method of increasing the surface hardness of low carbon, unalloyed, or low carbon, low alloy steels by increasing the carbon content in the exposed surface of steel. A carburized steel article, such as a gear, can transmit higher torques and have longer lives when they are carburized to produce a hard, wear resistant case. Typically, steel alloys are placed in an atmosphere containing carbon in an amount greater than the base carbon content of the steel and heated to a temperature above the austenite transformation temperature of steel. After the desired amount of carbon has been diffused into the article to a predetermined depth, hardness is induced by quenching.

Gas carburizing is a widely used method for carburizing steel. Being a diffusion process, carburizing is affected by the amount of alloying elements in the steel composition and the carburizing process parameters such as the carbon potential of the carburizing gas, the carburizing temperature, and the carburizing time.

Typical carburizing seeks to create a hardened case of martensite with some amount of retained austenite. It is normally considered unfavorable to form carbides during carburizing because they can weaken the material. Carbides can act as flaws that concentrate and localize strain and lead to subsurface cracks. In other applications, such as rolling and sliding applications, carbides are deliberately created to help refine grain size, reduce friction or improve pitting and scoring performance. In the few cases where carbides are intentionally created, a great deal of care is taken to control the carbide morphology and avoid high aspect ratio grain-boundary carbides that can drastically reduce performance. The depth of the carbide layer is typically a small fraction of the total carburized depth.

Another method of improving the performance and life of an article such as a gear tooth is to reduce operating contact stresses by improving geometric accuracy. Hard finishing of an article results in improved geometric accuracy and tighter manufacturing tolerances. Hard finishing, whether by grinding, honing, skiving, or some other technique, allows for the removal of distortion caused by heat treatment or some other manufacturing operation.

However, increasing demands for longer lives and higher power have exceeded the capabilities of either carbide carburized cases or hard finished faces. Hard finishing and carbide carburization have previously been two mutually exclusive techniques to improve rolling contact fatigue life. In the past, hard finishing would remove most, if not all, of the thin layers of carbides in the carburized case that may provide improved performance. The present invention seeks to combine these two aforementioned life improvement techniques to provide higher life and greater performance characteristics.

Some in the field have undertaken the task of trying to create carbides below the surface. Unfortunately, the focus has been on controlling the carbide morphology and creating fine spherical or spheroidal carbides through very specific processes while preventing the formation of massive non-spheroidal carbides. This technique, however, seeks to create fine spherical or spheroidal carbides in order to reduce the formation or break up the formation of the net shape or massive carbides in the austenite grain boundaries. Net shape or massive carbides in the austenite grain boundaries normally act as weak points or preferential crack points in the material.

SUMMARY OF THE INVENTION

It is to be understood that both the background and the following detailed description are exemplary and explanatory only and are not restrictive of the invention as claimed.

The present invention relates to a method for forming an article having a surface including a predetermined density of carbides. This method comprises selecting a carburizing grade material to form an article, carburizing the article to form a microstructure on at least one portion of the article having a predetermined density of carbides dispersed in the microstructure to a predetermined depth, quenching the article to form a hardened matrix dispersed with carbides on at least one portion of the article and hard finishing at least one portion of the article to form the surface, the surface having at least approximately 20% by volume fraction carbides dispersed in the hardened matrix.

BRIEF DESCRIPTION OF THE DRAWINGS

The accompanying drawings, which are incorporated in and constitute a part of this specification, illustrate several exemplary embodiments of the invention and, together with the description, serve to explain the principles of the invention. In the drawings.

DETAILED DESCRIPTION

Reference will now be made in detail to embodiments of the invention, examples of which are illustrated in the accompanying drawings. Whenever possible, the same reference numbers will be used throughout the drawings to refer to the same or like parts.

A method for forming an article includes selecting a carburizing grade material, shaping the material to form the article, carburizing the article to create carbides below the surface of the article, quenching the article to form a hardened matrix, and hard finishing the article to leave a surface comprising a predetermined density of substantially non-spheroidal carbides.

The selection of a material may affect the hardenability of the article and the carbide formation. Typical materials for this method will have compositions, by weight, within about the following ranges:

| | |
|---|---|
| Carbon | 0.08%–0.35% |
| Manganese | 0.25%–1.70% |
| Molybdenum | 0.20%–2.00% |
| Chromium | 0.50%–2.50% |
| Copper | 0.00%–0.15% |
| Nickel | 0.00%–0.10% |
| Carbide Forming Elements | 1.00%–3.00% |
| Hardenability Agents | 0.00%–6.00% |
| Grain Refining Elements | 0.00%–1.00% |
| Silicon | 0.00%–1.00% |
| Iron and Residual Elements | Balance |

Forming of the articles having any of the above-described compositions to a predetermined shape can comprise, but may not be limited to machining from rolled steel, casting or forging, consolidating steel powder, or a combination of forming operations. These articles may comprise, but are not limited to gear teeth, bearings, shafts and other similar objects that would benefit from rolling contact fatigue strength, scoring resistance and wear resistance.

Figure 1:
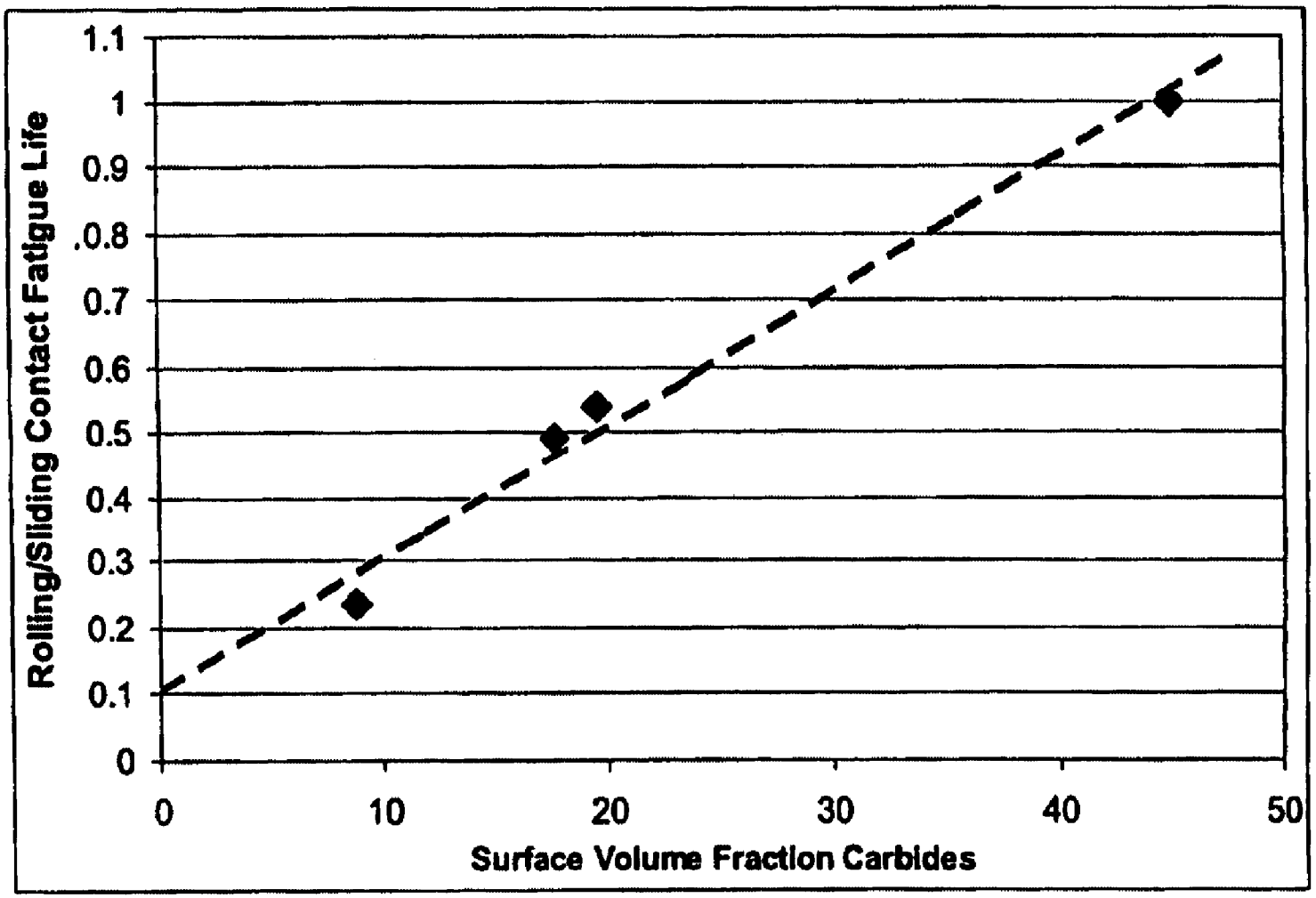
FIG. 1 is a graph of contact fatigue life versus percent surface carbides according to an embodiment of the present invention.

FIG. 1 is a graph of contact fatigue life versus percent surface carbides according to an embodiment of the present invention. This graph was generated using geared roller test machine data of specimens given identical heat treatments but ground to different depths prior to testing. The trend in FIG. 1 indicates that greater rolling and sliding contact fatigue life may be realized by higher surface carbides on the as tested surface. One embodiment of this invention has at least approximately 20% carbides on the portion of an article surface that sees rolling and sliding contact fatigue and is created by controlling the carburizing process to produce this quantity of carbides at the pre-determined hard finish depth. The maximum percentage of carbides generated at the hard finish depth may be limited based on carburizing processing costs to achieve a predetermined depth and may be limited based on the particular application due to hardened depth.

Figure 2:
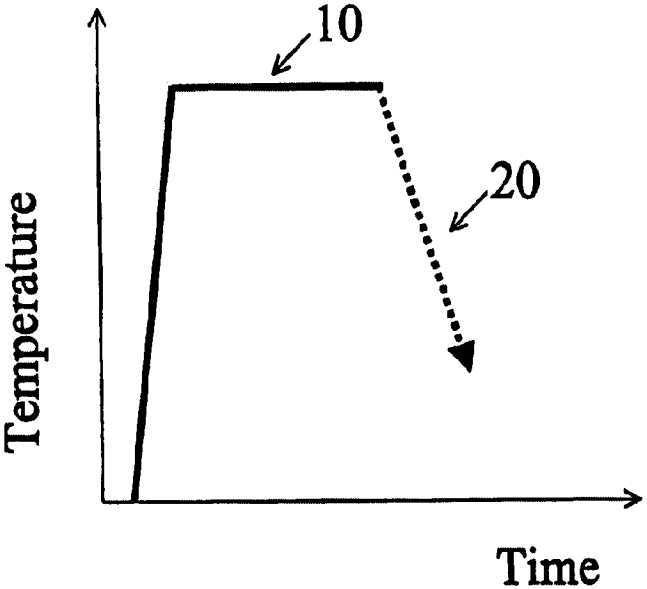
FIG. 2 is a graph illustrating the time and temperature relationship of a carburizing cycle showing one embodiment of the present invention.

FIG. 2 is a graph illustrating the time and temperature relationship of a carburizing cycle showing one embodiment of the present invention. After forming, the article may then be carburized one or more times according to this cycle, thus comprising a carbide carburizing process. This process may be controlled to produce greater than approximately 20% by volume fraction of carbides or more. These carbides will be of a variety of shapes and sizes dispersed throughout the microstructure. The carburizing cycle as seen in FIG. 2 begins by heating the article up to the carburizing segment 10. According to one embodiment of the invention, the carburizing segment 10 should maintain a carburizing temperature range between approximately 850° C. (1562° F.) to 1150° C. (2100° F.) and a carbon bearing atmosphere range approximately equal to or greater than the $A_{cm}$ for the carburizing temperature, although other temperatures may be used depending on the desired results. The article may then be held in the carburizing segment 10 for a predetermined time based on the desired case depth and total number of carburizing cycles. The cooling segment 20 of FIG. 2 will generally depend upon the amount and distribution of carbides sought in the article and may be limited depending upon the type of equipment being used. The cooling speed of the cooling segment may typically vary from about 2° C. to 200° C./minute per the cooling environment, although other cooling speeds may also be possible.

As mentioned above, the carbide carburizing process may consist of repeated carburizing cycles as seen in FIG. 2. Repeating the cycle may cause the carbide morphologies, depths and distributions to significantly change. Characteristics of the carbide carburizing process may depend on the application, the material, the time available for processing and other potential furnace limitations.

After the carbide carburizing process is complete, the hardening may begin and may also occur in one or more cycles. A typical hardening cycle would entail heating the article to a temperature above the A3 temperature of the base composition. It is desirable, however, to keep the temperature as low as possible to avoid carbide dissolution. It may also be desirable to ensure a furnace atmosphere that avoids carbon loss from the surface. Ammonia additions to the furnace atmosphere may also be desirable to avoid non-martensitic transformation products especially since much of the alloy is tied up in carbides and cannot provide matrix hardenability. The time at that temperature will typically be dictated by section size and the amount of time it takes for the temperature of the part to be at a temperature above A3 of the base composition so that quenching may begin. The time will be typically anywhere from about 15 to 90 minutes per 25 mm of part thickness. Quenching may then be performed at a sufficient rate to form the predetermined hardened matrix. In some cases, parts may be quenched to a temperature just above the Martensite start temperature (hereinafter 'Ms') and held isothermally to form a matrix with a predetermined portion of bainite. In other cases, the parts may be quenched to a temperature below the Ms to form a matrix consisting of martensite or a mixture of martensite and retained austenite.

Figure 3:
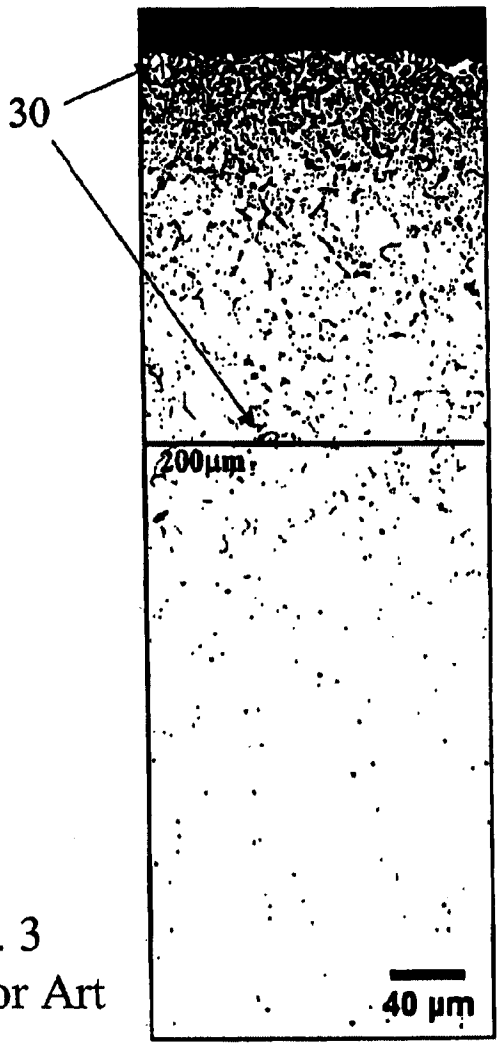
Fig. 3 Prior Art
FIG. 3 is a photomicrograph, at 500×, of an etched section of a carbide carburized case depicted by the prior art, using an etch to make the carbides dark and the matrix light.

FIG. 3 is a photomicrograph, at 500×, of an etched section of a carbide carburized case depicted by the prior art, using an etch to make the carbides dark and the matrix light. The carbides 30 are concentrated within the first 50 μm. A relatively low density of carbides 30, less than about 20% by volume fraction, are present at a depth of 200 μm because the time during the carburizing segment 10 of FIG. 2 was limited to focus on the formation of a high density of carbides 30 at the surface.

Figure 4:
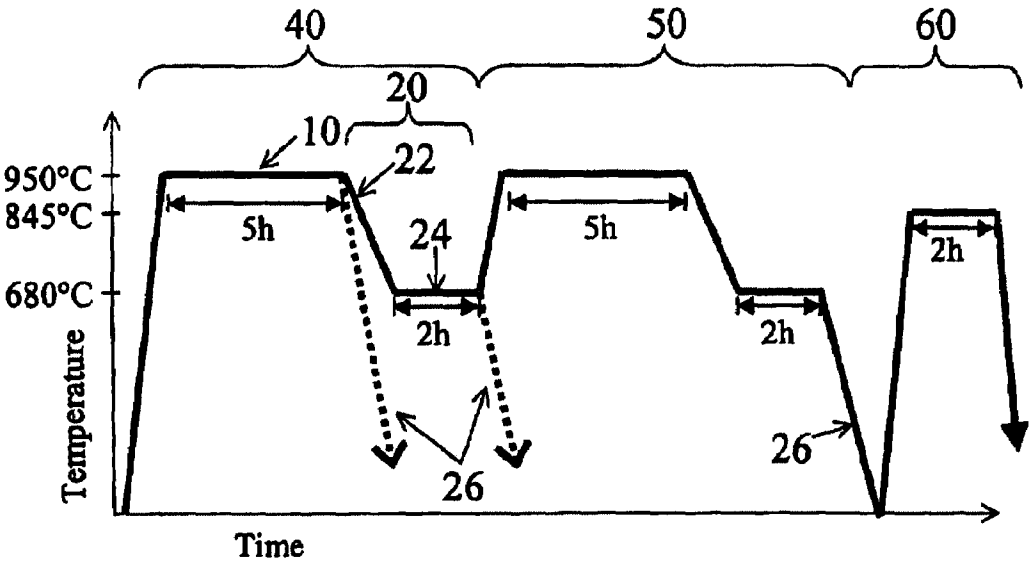
FIG. 4 is a graph illustrating the time and temperature relationship of a carburizing cycle, according to one embodiment of the invention.

FIG. 4 is a graph illustrating the time and temperature relationship of a carburizing cycle, according to one embodiment of the present invention.

This embodiment shows a first carbide carburizing cycle 40, a second carbide carburizing cycle 50 and a hardening cycle 60. The carburizing segment 10 occurred at a temperature of approximately 950° C. and was maintained under a carbon-bearing atmosphere of endothermic gas, trimmed with excess methane, for approximately 5 hours. The cooling segment 20 is further defined by a force cool 22, an isothermal hold 24 and an optional gas cool 26. The force cool 22 consists of lowering the temperature of a sample in the furnace under a carbon-bearing atmosphere at a rate of about 2° C./minute from the temperature at the carburizing segment 10 to the isothermal hold 24 at a temperature of approximately 680° C. The cycle then is held at the isothermal hold 24 for 2 hours under atmosphere control to avoid the loss of surface carbon. Alternatively or in addition to the force cool 22 and the isothermal hold 24, a gas cool 26 may be conducted before repeating the thermal cycle in the second carbide carburizing cycle 50. The gas cool 26 is a more rapid cool than the force cool 22.

After the gas cool 26 of the second carbide carburizing cycle 50, the hardening cycle 60 may be performed by reheating to approximately 845° C. and holding for 2 hours under a carbon-bearing atmosphere. A sample may then be quenched in oil at a rate sufficient to form a hardened matrix consisting of martensite with inherent retained austenite.

Figure 5:
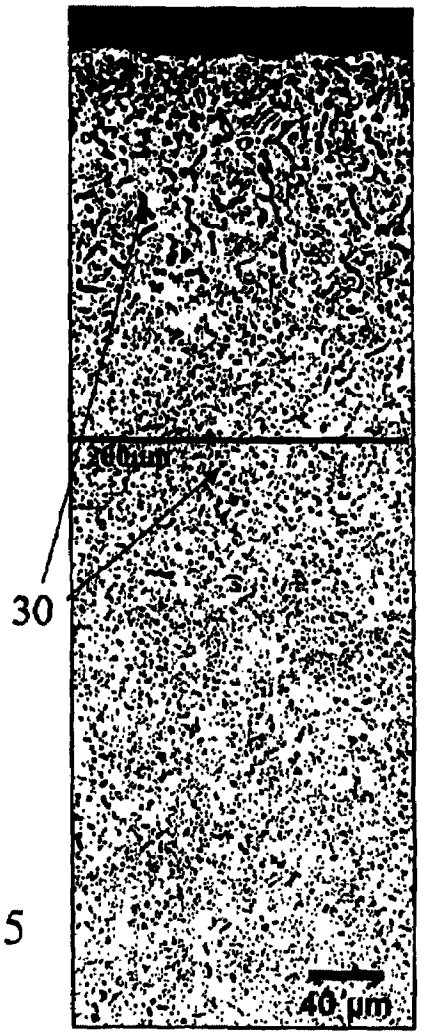
FIG. 5 is a photomicrograph, at 500×, of an etched section of a carbide carburized case, using an etch to make the carbides dark and the matrix light, created according to one embodiment of the present invention as shown in FIG. 4.

FIG. 5 is a photomicrograph, at 500×, of an etched section of a carbide carburized case, using an etch to make the carbides dark and the matrix light, according to one embodiment of the invention. This sample was formed using the two carburizing cycles and one hardening cycle of the thermal history shown in FIG. 4. A significantly higher density of carbides 30 is present at 200 μm below the surface as compared to FIG. 3. FIG. 5 has a material composition as follows:

| | |
|---|---|
| Carbon | 0.21% |
| Manganese | 0.32% |
| Silicon | 0.48% |
| Molybdenum | 0.30% |
| Chromium | 2.05% |
| Iron and Residual Elements | Balance |

Figure 6:
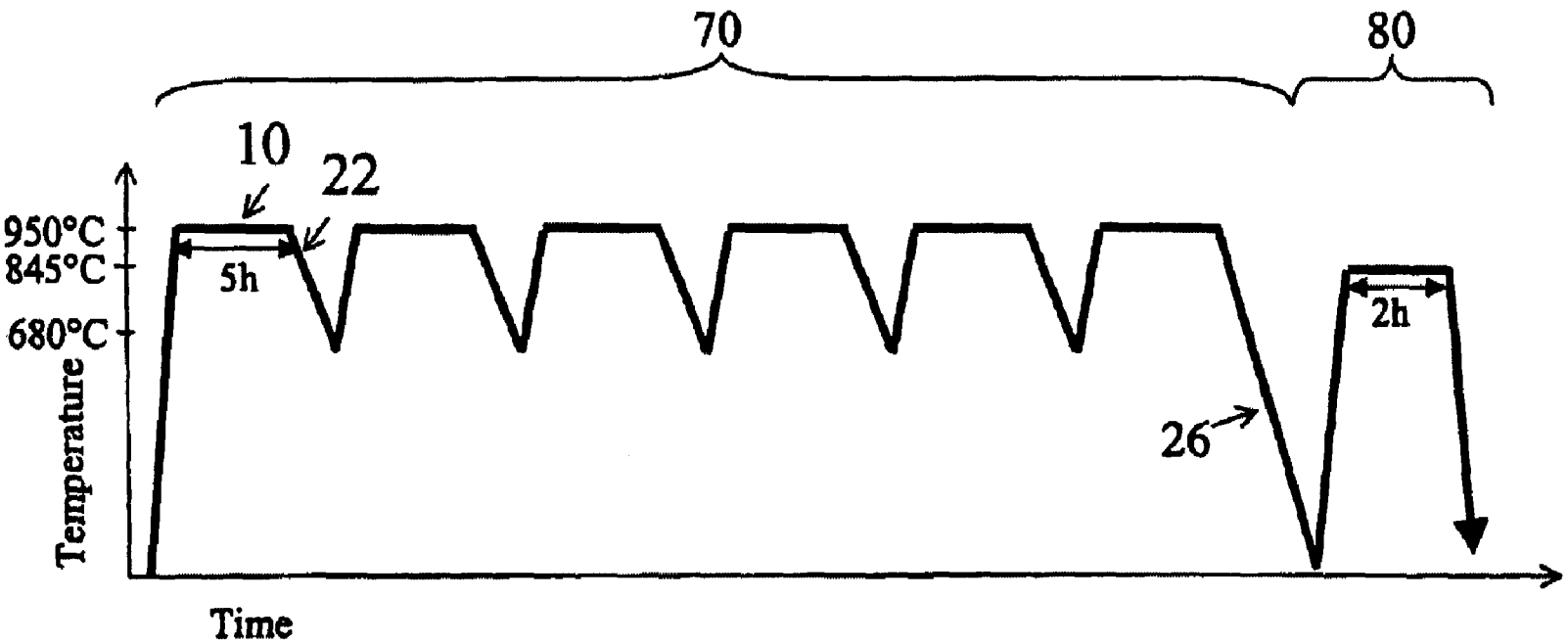
FIG. 6 is a graph illustrating the time and temperature relationship of a carburizing cycle, according to another possible embodiment of the present invention.

FIG. 6 is a graph illustrating the time and temperature relationship of a carbide carburizing cycle, according to another possible embodiment of the present invention. This embodiment shows six carburizing cycles 70 and a hardening cycle 80. Each carburizing segment 10 occurred at a temperature of approximately 950° C. and was maintained under a carbon-bearing atmosphere of endothermic gas, trimmed with methane, for approximately 5 hours. A force cool 22 was then performed, lowering the temperature of a sample in the furnace under a carbon-bearing atmosphere at a rate of about 2° C./minute from the temperature at the carburizing segment 10 to a temperature of approximately 680° C. The temperature was then returned to the carburizing segment temperature and the cycle was repeated until six cycles were completed. At the end of the carburizing segment 10 of the sixth cycle, the samples were gas cooled 26.

After the gas cool 26 of the second carbide carburizing cycle 50, the hardening cycle may be performed by reheating to approximately 845° C. and holding for 2 hours under a carbon-bearing atmosphere. The sample was then quenched in oil at a rate sufficient to form a hardened matrix consisting of martensite with inherent retained austenite.

Figure 7:
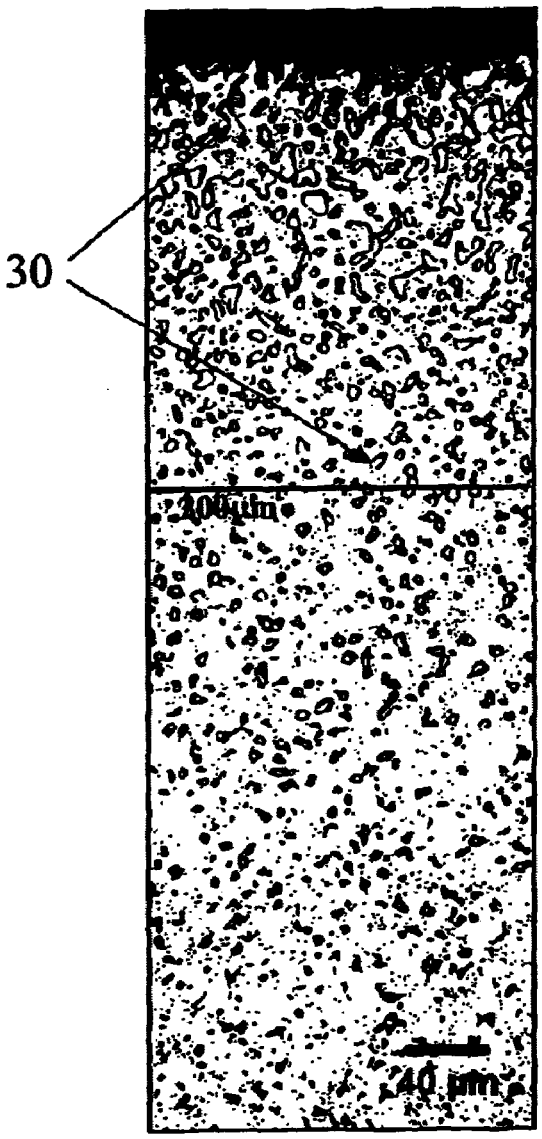
FIG. 7 is a photomicrograph, at 500×, of an etched section of a carbide carburized case, using an etch to make the carbides dark and the matrix light, created according an embodiment of the present invention as shown in FIG. 6.
Figure 8:
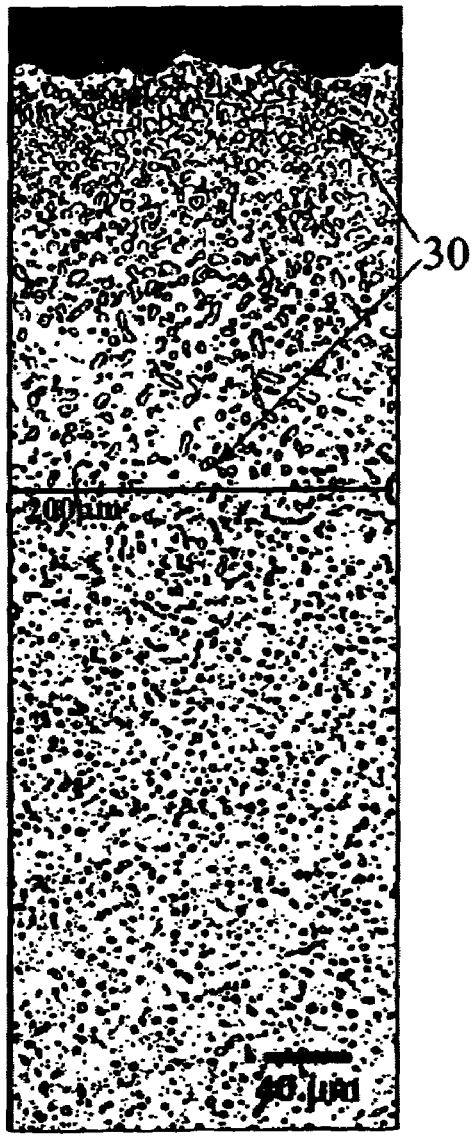
FIG. 8 is a photomicrograph, at 500×, of an etched section of a carbide carburized case, using an etch to make the carbides dark and the matrix light, according to an embodiment of the present invention as shown in FIG. 6, but using a different composition than FIG. 7.

FIGS. 7 and 8 are photomicrographs, at 500×, of etched sections of a carburized carbide case, using an etch to make the carbides dark and the matrix light, created according to the embodiment of the present invention as shown in FIG. 6. Although FIG. 8 was created according to the same carburizing cycles as the photomicrograph in FIG. 7, it is a different material. The samples have material composition as follows:

| | FIG. 7 | FIG. 8 |
|---|---|---|
| Carbon | 0.21% | 0.20% |
| Manganese | 0.88% | 0.31% |
| Silicon | 0.24% | 0.48% |
| Molybdenum | 0.33% | 0.21% |
| Chromium | 0.96% | 2.41% |
| Iron and Residual Elements | Balance | Balance |

Both samples also have a high density of carbides 30 at 200 μm from the surface as compared to FIG. 3. However, the carbides 30 seen in both of these samples are typically larger than the carbides 30 seen in FIG. 5. The primary difference between FIG. 7 and FIG. 8 is the size and quantity of carbides 30 present in the microstructure. The quantity of carbides 30 is greater in FIG. 8 due to higher quantity of carbide forming elements present in the base material. The smaller size of carbides 30 and smaller spacing of the carbides 30 in FIG. 8 is likely due to the increased percentage of silicon in the material.

As shown in the above FIGS. 5, 7 and 8, carbide 30 size, morphology and depth can be controlled through material and process selection. For example, FIGS. 5, 7 and 8 may have high volume fractions of carbides 30 at depth because of increased amounts of carbide forming elements. Increasing the carburizing temperature may also increase the volume fraction of carbides 30 at predetermined depth in the microstructure. An increased carburizing potential during the carburizing segment 10 may also increase the carbide quantity. If the amount of silicon is increased, the carbides 30 may be smaller and more round as seen in FIG. 8. Using a force cool 22 instead of a more rapid gas cool 26 between the carburizing cycles or after the last carburizing cycle may also cause the carbides 30 to be larger. Also, by increasing the number of carburizing cycles, the smaller carbides 30 may be dissolved and re-precipitated back onto the larger carbides 30. This will create even larger carbides 30 while still causing grain boundary network carbides to be broken up.

By tailoring the carburizing process, it may be possible to choose the depth, size, distribution, and density of carbides. This may facilitate the ability of the manufacturer to know and specify the depth of hard finishing to achieve a certain percentage, or a predetermined density of carbides at the finished surface. For example, the samples in FIGS. 4, 6 and 7 may be hard-finished to remove approximately 200 μm from the unfinished surface of the sample leaving a predetermined density of carbides in a hardened matrix at the finished surface. The percentage of substantially non-spheroidal carbides may also be higher at the surface due to the hard finish operation. The hard-finishing process can be performed in a number of ways, and is not limited to grinding, machining, honing and skiving.

Although a limited number of embodiments of the present invention have been shown, these embodiments and even those at a more basic level have shown consistent amounts of carbide 30 formation. Control of carbide 30 formation may allow the user to grow the carbides 30 to a more massive and substantially non-spheroidal size. These larger carbides 30 have been shown in the past to improve surface durability under rolling and sliding contact fatigue. By growing the carbides 30 at a predetermined depth, these massive carbides may now be utilized in combination with hard finishing. Typically, the bigger and more blocky the carbide the better. Additionally, formation of massive carbides along the grain boundaries may not matter if formed within the depth removed by hard finishing.

INDUSTRIAL APPLICABILITY

Articles formed according to the above may be particularly useful as gear teeth, bearings, shafts and similar objects that are exposed to forces that may cause unfavorable wear, pitting, scoring and other failures. The formation of carbides from the surface deep into the material combined with hard finishing at least one portion of the article may be of particular benefit in heavy wear applications, such as that seen with roller bearings. Bearings may typically be understood to include any of the components of the bearing such as the bearing races and the rolling element members, including balls and rollers. The formation of carbides and a hard finishing operation may occur on at least one of these components.

Because of the increasing demands for longer life and higher power densities, a hard finished article with a predetermined density of carbides in the surface may be beneficial. The carbides provide for increased material strength while the subsequent hard finish operation may result in increased geometric accuracy for better contact and a reduction in operating stresses in the surface of the material. The combination of the processes may improve pitting and wear resistance to significantly increase the overall life of the article.

By intentionally putting the carbides deeper to allow more stock for hard finishing, carbides may be created within a usable range in order to allow hard finishing to remove the variability of the processed material. Being able to predetermine the depth of carbides for hard finishing may also allow for reduced finish processing time and provide significantly improved wear and pitting resistance. Furthermore, where the hard finish operation may be performed to minimize the total amount of stock being removed, higher surface carbide levels may be obtained and even greater pitting resistance and wear resistance may result.

The invention claimed is:

1. A method for forming an article having a surface including a predetermined density of carbides, comprising:

selecting a carburizing grade material to form an article;

carburizing the article to form a microstructure on at least one portion of the article having a predetermined density of carbides dispersed in the microstructure to a predetermined depth;

quenching the article to form a hardened matrix dispersed with carbides on at least one portion of the article; and removing material from at least one portion of the article by hard-finishing to form the surface having at least approximately 20% by volume fraction carbides dispersed in the hardened matrix.

2. The method for forming an article as set forth in claim 1 wherein the carburizing and quenching of the article comprises producing at least approximately 20% by volume fraction carbides in a hardened matrix at least approximately 100 μm below a hardened surface of the article.

3. The method for forming an article as set forth in claim 1 wherein the surface of the article comprises at least approximately 1.3% carbon.

4. The method for forming an article as set forth in claim 1 wherein the hard-finishing of the article comprises the removal of at least approximately 50 μm of material from a hardened surface of the article such that the surface of the article includes at least approximately 20% by volume fraction carbides in a hardened matrix.

5. The method for forming an article as set forth in claim 1 wherein the carbides at the surface are substantially non-spheroidal.

6. The method for forming an article as set forth in claim 1 wherein selecting a carburizing grade material comprises selecting a material including, by weight percent, from about 0.08% to about 0.35% carbon, from about 0.25% to about 1.70% manganese, from about 0.20 to about 2.00% molybdenum, from about 0.50% to about 2.50% chromium, not more than about 0.10% nickel, not more than about 0.15% copper, from about 1.00% to about 3.00% carbide forming elements, not more than about 6.00% hardenability agents, not more than about 1.00% grain refining elements and not more than about 1.00% silicon.

7. The method for forming an article as set forth in claim 1 wherein carburizing the article comprises:

heating the article up to a carburizing temperature from about 850° C. to about 1150° C.;

introducing a carbon bearing atmosphere to the article approximately equal to or greater than the $A_{cm}$ for the carburizing temperature;

holding the article at the carburizing temperature and the carbon bearing atmosphere for a predetermined time based on the desired predetermined case depth and predetermined number of carburizing cycles; and cooling the article to less than approximately 650° C. at a rate greater than from about 2° C. per minute to about 200° C. per minute.

8. The method for forming an article as set forth in claim 7, further comprising the addition of ammonia prior to quenching.

9. The method for forming an article as set forth in claim 1 wherein the hardened matrix comprises at least one of a predetermined portion of bainite, martensite and a mixture of martensite and retained austenite.

10. The method for forming an article as set forth in claim 1 wherein hard-finishing comprises the removal of a portion of the hardened matrix from the surface of the article by at least one of grinding, machining, honing and skiving.

11. A method for forming an article having a surface including a predetermined density of carbides, comprising:

selecting and shaping a carburizing grade material to form an article, the carburizing grade material including, by weight percent, from about 0.08% to about 0.35% carbon, from about 0.25% to about 1.70% manganese, from about 0.20 to about 2.00% molybdenum, from about 0.50% to about 2.50% chromium, not more than about 0.10% nickel, not more than about 0.15% copper, from about 1.00% to about 3.00% carbide forming elements, not more than about 6.00% hardenability agents, not more than about 1.00% grain refining elements and not more than about 1.00% silicon, heating the article up to a carburizing temperature from about 850° C. to about 1150° C.;

introducing a carbon bearing atmosphere to the article approximately equal to or greater than the $A_{cm}$ for the carburizing temperature;

carburizing the article at the carburizing temperature and the carbon bearing atmosphere for a predetermined time based on the desired predetermined case depth and predetermined number of carburizing cycles to form a microstructure on at least one portion of the article having a predetermined density of carbides dispersed in the microstructure to a predetermined depth;

cooling the article to less than approximately 650° C. at a rate greater than from about 2° C. per minute to about 200° C. per minute;

quenching the article to form a hardened matrix dispersed with a predetermined density of carbides dispersed in the microstructure to a predetermined depth on at least one portion of the article; and removing material from at least one portion of the article by hard-finishing to form the surface having at least approximately 20% by volume fraction carbides dispersed in the hardened matrix.

12. The method for forming an article as set forth in claim 11, further comprising the addition of ammonia prior to quenching.

13. A method for forming a gear tooth having a surface including a predetermined density of carbides, comprising:

selecting a carburizing grade material to form the gear tooth;

carburizing the gear tooth to form a microstructure on at least one portion of the article having a predetermined density of carbides dispersed in the microstructure to a predetermined depth;

quenching the gear tooth to form a hardened matrix dispersed with carbides; and removing material from at least one portion of the gear tooth by hard-finishing to form the surface including at least approximately 20% by volume fraction carbides.

14. The method for forming a gear tooth as set forth in claim 13 wherein the surface of the gear tooth comprises at least approximately 1.3% carbon.

15. The method for forming a gear tooth as set forth in claim 13 wherein the carburizing and quenching of the gear tooth comprises producing at least approximately 20% by volume fraction carbides and at least approximately 1.3% carbon in the hardened matrix at least approximately 100 μm below a hardened surface of the gear tooth.

16. The method for forming a gear tooth as set forth in claim 13 wherein the hard-finishing of the gear tooth comprises the removal of at least approximately 50 μm of material from a hardened surface of the gear tooth such that surface of the gear tooth includes at least approximately 20% by volume fraction carbides in a hardened matrix.

17. The method for forming a gear tooth as set forth in claim 13 wherein the carbides at the surface are substantially non-spheroidal.

18. The method for forming a gear tooth as set forth in claim 13 wherein selecting a carburizing grade material comprises selecting a material including, by weight percent, from about 0.08% to about 0.35% carbon, from about 0.25% to about 1.70% manganese, from about 0.20 to about 2.00% molybdenum, from about 0.50% to about 2.50% chromium, not more than about 0.10% nickel, not more than about 0.15% copper, from about 1.00% to about 3.00% carbide forming elements, not more than about 6.00% hardenability agents, not more than about 1.00% grain refining elements and not more than about 1.00% silicon.

19. The method for forming a gear tooth as set forth in claim 13 wherein carburizing the article comprises:

heating the gear tooth up to a carburizing temperature from about 850° C. to about 1150° C.;

introducing a carbon bearing atmosphere to the gear tooth approximately equal to or greater than the $A_{cm}$ for the carburizing temperature;

holding the gear tooth at the carburizing temperature and the carbon bearing atmosphere for a predetermined time based on the desired predetermined case depth and predetermined number of carburizing cycles; and cooling the gear tooth to less than approximately 650° C. at a rate greater than from about 2° C. per minute to about 200° C. per minute.

20. The method for forming a gear tooth as set forth in claim 19, further comprising the addition of ammonia prior to quenching.

21. The method for forming a gear tooth as set forth in claim 13 wherein the hardened matrix comprises at least one of a predetermined portion of bainite, martensite and a mixture of martensite and retained austenite.

22. The method for forming a gear tooth as set forth in claim 13 wherein hard-finishing comprises the removal of a portion of the hardened matrix from the surface of the gear tooth by at least one of grinding, machining, honing and skiving.

23. A method for forming a bearing having a surface including a predetermined density of carbides, comprising:

selecting a carburizing grade material to form the bearing;

carburizing the bearing to form a microstructure on at least one portion of the article having a predetermined density of carbides dispersed in the microstructure to a predetermined depth;

quenching the bearing to form a hardened matrix dispersed with carbides on at least one portion of the bearing; and removing material from at least one portion of the bearing by hard-finishing to form the surface including at least approximately 25% by volume fraction carbides.

24. The method for forming a bearing as set forth in claim 23 wherein the surface of the bearing comprises at least approximately 1.5% carbon.

25. The method for forming a bearing as set forth in claim 23 wherein the carburizing and quenching of the bearing comprises producing at least approximately 25% by volume fraction carbides and at least approximately 1.5% carbon in the hardened matrix at least approximately 100 μm below a hardened surface of the bearing.

26. The method for forming a bearing as set forth in claim 23 wherein the hard-finishing of the bearing comprises the removal of at least approximately 50 μm of material from a hardened surface of the bearing such that surface of the bearing includes at least approximately 25% by volume fraction carbides in a hardened matrix.

27. The method for forming a bearing as set forth in claim 23 wherein the carbides at the surface are substantially non-spheroidal.

28. The method for forming a bearing as set forth in claim 23 wherein selecting a carburizing grade material comprises selecting a material including, by weight percent, from about 0.08% to about 0.35% carbon, from about 0.25% to about 1.70% manganese, from about 0.20 to about 2.00% molybdenum, from about 0.50% to about 2.50% chromium, not more than about 0.10% nickel, not more than about 0.15% copper, from about 1.00% to about 3.00% carbide forming elements, not more than about 6.00% hardenability agents, not more than about 1.00% grain refining elements and not more than about 1.00% silicon.

29. The method for forming a bearing as set forth in claim 23 wherein carburizing the bearing comprises:

heating the bearing up to a carburizing temperature from about 850° C. to about 1150° C.;

introducing a carbon bearing atmosphere to the bearing approximately equal to or greater than the $A_{cm}$ for the carburizing temperature;

holding the bearing at the carburizing temperature and the carbon bearing atmosphere for a predetermined time based on the desired predetermined case depth and predetermined number of carburizing cycles; and cooling the bearing to less than approximately 650° C. at a rate greater than from about 2° C. per minute to about 200° C. per minute.

30. The method for forming a bearing as set forth in claim 29, further comprising the addition of ammonia prior to quenching.

31. The method for forming a bearing as set forth in claim 23 wherein the hardened matrix comprises at least one of a predetermined portion of bainite, martensite and a mixture of martensite and retained austenite.

32. The method for forming a bearing as set forth in claim 23 wherein hard-finishing comprises the removal of a portion of the hardened matrix from the surface of the bearing by at least one of grinding, machining, honing and skiving.

33. The method as set forth in claim 1, wherein the article is a gear tooth or a bearing.

* * * * *